US006336508B1

(12) United States Patent
Guinn

(10) Patent No.: US 6,336,508 B1
(45) Date of Patent: Jan. 8, 2002

(54) SUBSEA, RELEASABLE BOP FUNNEL

(75) Inventor: Roy Mitchell Guinn, Houston, TX (US)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 09/550,034

(22) Filed: Apr. 14, 2000

Related U.S. Application Data

(60) Provisional application No. 60/177,560, filed on Jan. 21, 2000.

(51) Int. Cl.[7] ..... E21B 33/38

(52) U.S. Cl. ..... 166/339; 166/342; 166/349; 166/365; 166/368

(58) Field of Search ..... 166/363, 335, 166/338, 342, 344, 349, 351, 365, 368; 405/195.1, 224; 285/18, 24, 27, 29

(56) References Cited

U.S. PATENT DOCUMENTS 4,290,715 A * 9/1981 Beynet et al.
4,408,784 A * 10/1983 Reimert
4,867,605 A * 9/1989 Myers et al.
6,161,620 A * 12/2000 Cox et al.

* cited by examiner

*Primary Examiner*—Roger Schoeppel

(57) ABSTRACT

The invention is a device for eliminating the "tripping" of the BOP stack to the surface when switching between drilling and completion modes of operation on a drilling rig. This device is a new apparatus for attaching a BOP guide funnel, which will allow the funnel to be released and/or reattached while the BOP remains subsea on or near the seafloor. The new BOP guide funnel assembly consists of three basic components: a guide funnel, a connector shroud and a parking pile adapter. The guide funnel has a downwardly opening funnel on bottom (used to capture a wellhead) and an upwardly opening smaller funnel on top (used to guide the shroud back into the guide funnel during re-installation of the guide funnel). The connector shroud is permanently attached to the bottom of the BOP stack, surrounding the BOP wellhead connector and holds the guide funnel in place. The connector shroud also acts as a guide for entering other subsea equipment designed in a funnel-up configuration when the guide funnel is not present. The connector shroud includes a latching mechanism for releasing and/or reattaching the guide funnel. The latching mechanism may be controlled either by the BOP control system or by intervention from a remotely operated vehicle (ROV). The parking pile adapter is designed to "store" the funnel at the seafloor when it has been released from the BOP stack.

8 Claims, 3 Drawing Sheets

SUBSEA, RELEASABLE BOP FUNNEL

This application claims the benefit of U.S. Provisional Application No. 60/177,560 filed Jan. 21, 2000.

BACKGROUND OF THE INVENTION

1. Field of the Invention

The invention is related to methods and apparatus for use in drilling and completion operations on a subsea well from an offshore drilling rig, particularly in those operations which involve running and retrieving the subsea-deployed blowout preventer (BOP) stack.

2. Description of Related Art

Historically, a subsea-deployed blowout preventer (BOP) stack performs most of its drilling functions with a downwardly opening funnel located at the bottom of the stack at the BOP-mounted wellhead connector. The funnel allows the operator to capture the wellhead while the BOP stack is suspended over location from the drilling rig. However, when the operator switches from drilling to completion operations, the BOP stack must usually enter (stab into) subsea equipment that has a funnel-up configuration. This means that the downwardly opening facing funnel on the BOP stack must be removed in order for the BOP to stab into the subsea equipment. Prior to the present invention, in order to remove the funnel, the BOP had to be "tripped" to the surface, a routine but costly and time-consuming operation. However, in deepwater applications in recent years, this has begun to be an extremely costly trip (taking upwards of 2–3 days and more at rig rates of greater than $200,000/day). Furthermore, when completion operations are over and it is time to switch the BOP stack configuration back to a drilling mode, the funnel must be re-installed on the BOP stack in order to enable the BOP stack to capture the next wellhead. This requires still another "tripping" operation to bring the BOP back to the surface and into the BOP storage area on the drilling rig in order to reinstall the funnel. The re-installation at the surface involves substantial manpower and heavy lifting equipment and is considered a dangerous activity due to the weight of the funnel (5–6,000 lbs.) and its location at the bottom of the BOP stack. It is the purpose of the present invention, therefore, to eliminate the costly, time-consuming and dangerous "tripping" operational requirements of the prior art.

SUMMARY OF THE INVENTION

The invention is a device whose purpose is to eliminate the "tripping" of the BOP stack when it is desired to switch operations between drilling and completion activities. The device is a new mechanism for attaching a BOP guide funnel and which will allow the guide funnel to be released and/or reattached while the BOP remains subsea on or near the seafloor. The new BOP funnel mechanism consists of three basic components: a guide funnel, a connector shroud and a parking pile adapter. The guide funnel is a structure with a downwardly opening funnel on the bottom (used to capture a wellhead) and an upwardly opening smaller funnel on top (used to guide the shroud back into the guide funnel during re-installation of the funnel). The connector shroud is a structure that is permanently attached to the bottom of the BOP stack. It surrounds the BOP wellhead connector and holds the guide funnel in place. The connector shroud also acts as a guide allowing the BOP stack to enter other subsea equipment, which is designed in a funnel-up configuration. The connector shroud includes a latching mechanism for releasing and/or reattaching the guide wide funnel. The latching mechanism may be controlled either by the BOP control system or by intervention from a remotely operated vehicle (ROV). The parking pile adapter is a structure designed to "store" the funnel at the seafloor after it has been released from the BOP stack.

DESCRIPTION OF THE PREFERRED EMBODIMENT

Figure 1A:
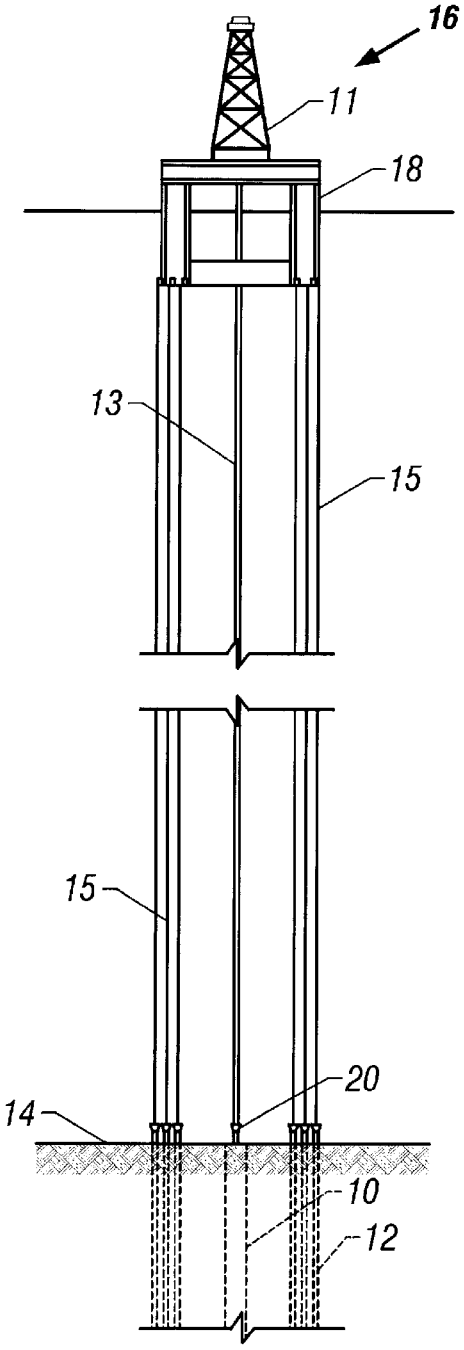
FIG. 1A (Prior Art)
FIGS. 1A and 1B comprise a conceptual drawing of a typical environment in which the invention may be used.

The new BOP guide funnel system described herein consists of three basic components: a guide funnel, a connector shroud and a parking pile adapter.

The guide funnel, according to the present invention, opens downwardly and is held in place around the shroud by a latching mechanism, which will be described below. The funnel and connector shroud are designed to fit the particular BOP-mounted wellhead connector and BOP stack frame. The guide funnel has an internal groove to accept a set of locking dogs (part of the latching mechanism) that extend from the shroud. The guide funnel/shroud assembly is designed to withstand the loads required to support the BOP stack during landing operations. The guide funnel is fitted with padeyes, shackles and slings which are used to raise the funnel from the seafloor after it has been released in circumstances where the parking pile adapter is not available or is in service at the location. These may also be used to recover the funnel in an emergency situation.

The connector shroud is a structure that is permanently attached to the BOP stack frame. It is modified to fit a particular BOP stack frame (built by one of many fabricators) and the particular BOP-mounted wellhead connector of choice (also built by one of many manufacturers). BOP stack frames and wellhead connectors are well known to those skilled in the art. The connector shroud houses the hydraulic tubing, valves and cylinders of the latching mechanism, which locks the funnel in place when needed and releases it when it is not required. The connector shroud also serves as a centering guide for the BOP stack frame, allowing the BOP-mounted wellhead connector to enter various other types of subsea equipment, since they are usually designed in a "funnel-up" configuration.

The latching mechanism includes permanently mounted parts located inside the frame of the connector shroud that lock the guide funnel in place when needed and release the guide funnel when not required. These parts comprise hydraulic cylinders, tubing, spring-loaded mechanical "locking dogs", a wedge driving block and the associated framework to hold these pieces in their proper place. The spring-loaded locking dogs are extended by spring tension and fit into a groove on the guide funnel to keep it in place when required. When it is desired to release the funnel, hydraulic pressure is applied from the BOP stack (or a Remotely-Operated Vehicle "ROV") to power the cylinders which in turn drive the wedge into the locking dogs and cause them to retract, thereby releasing the funnel. If it is desired to reattach the funnel, the hydraulic pressure is released and the locking dogs extend out by virtue of the spring tension. A slight taper on the dogs allows them to be driven by the weight of the BOP stack into a groove on the funnel where they snap into place, thereby holding the funnel onto the shroud. The controlling hydraulic pressure can be reversed if it is desired, with the spring tension retracting the locking dogs. However, the preferred method is to have the locking dogs extended by spring tension. This allows a more positive "unlock" function, since the real time savings occurs when it is necessary to drop the funnel off of the stack. The BOP control system on the rig must have the necessary solenoid valves, tubing and control panel modifications in order to accommodate the extra functions of the funnel mechanism. In addition, and as is well known to those skilled in the art, the BOP stack is equipped with an ROV "hot stab" receptacle for use in case the BOP control system fails to operate the hydraulic mechanism. It is mounted in an appropriate position on the BOP stack frame, readily accessible to the rig's ROV.

The parking pile adapter consists of a support structure for a bucket designed to capture the guide funnel when it is released from the BOP stack. The adapter is held in a vertical position by a mechanical ROV-operated connector, which locks the adapter to an existing parking pile (if available) located on the seafloor. The bucket on top of the parking pile adapter is a sturdy frame used to capture the guide funnel as it is released from the BOP stack. It is designed to "center" the guide funnel in order to facilitate mating the guide funnel back to the BOP stack when needed. The parking pile adapter also has a shipping skid, which holds the adapter in an upright position for ease of offloading onto support boats or a drilling rig.

Figure 1B:
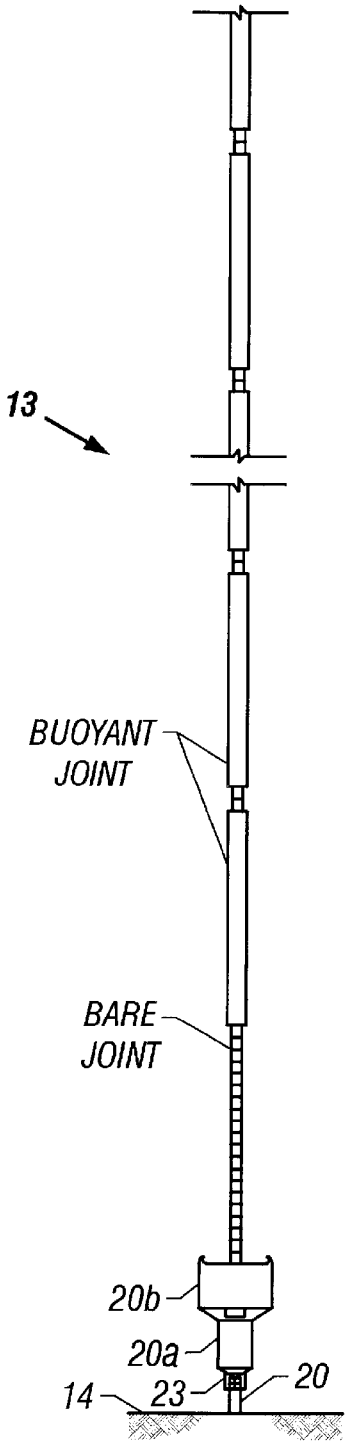
FIG. 1B (Prior Art)

Referring now to FIGS. 1A and 1B, which show a typical environment of the invention, tension leg platform (TLP) 16 having superstructure 18 is shown tethered to ocean floor 14 through a plurality of tendons 15 as is well known to those skilled in the art. TLP 16 is shown for purposes of illustration only and the invention may be used with any offshore drilling rig. Drilling and other operations are enabled by a derrick 11 supporting and controlling e.g., a drill string 13. The tendons 15 are secured to the ocean floor 14 by means of piles 12. The drill string 13 operates into casing 10 capped by a wellhead 20 and/or blowout preventer 20*a* also well known to those skilled in the art. FIG. 1B shows details of the configuration as it appears on the ocean floor 14. A BOP 20*a* is attached to the wellhead 20 and a Lower Marine Riser (LMRP) 20*b* is attached to the top of BOP 20*a*.

The main purpose of the LMRP, as is well known to those skilled in the art, is to allow the marine riser to be disconnected during an emergency situation and to provide a means for reattaching the marine riser to the BOP's while subsea. It usually consists of: 1) One (or two at the most) annular preventers, which will close or clamp down on certain sizes of pipe in the hole in order to seal in pressure below the wellhead; 2) a flexible joint connection on top for the marine riser, which connects the LMRP to the marine riser and allows for rig movement at the surface; 3) a high-angle release connector at the bottom which connects the LMRP to the top of the stack of BOP's; and 4) a re-entry system designed to guide the high-angle release connector back onto the stack of BOP's if it has been disconnected while subsea.

The LMRP will have the same bore size (usually 18¾"–21" for deepwater stacks) as the BOP stack below it and the riser above it, and will have means for connecting the choke and kill lines from the marine riser through to the BOP stack, as well as the electrical and hydraulic control lines. The LMRP may also have several valves along the choke and kill lines for isolation purposes. The LMRP also houses the BOP control pods and all the associated electrical and hydraulic lines, accumulator bottles, and other equipment used to control the BOP stack functions as is well known to those skilled in the art.

Figure 2:
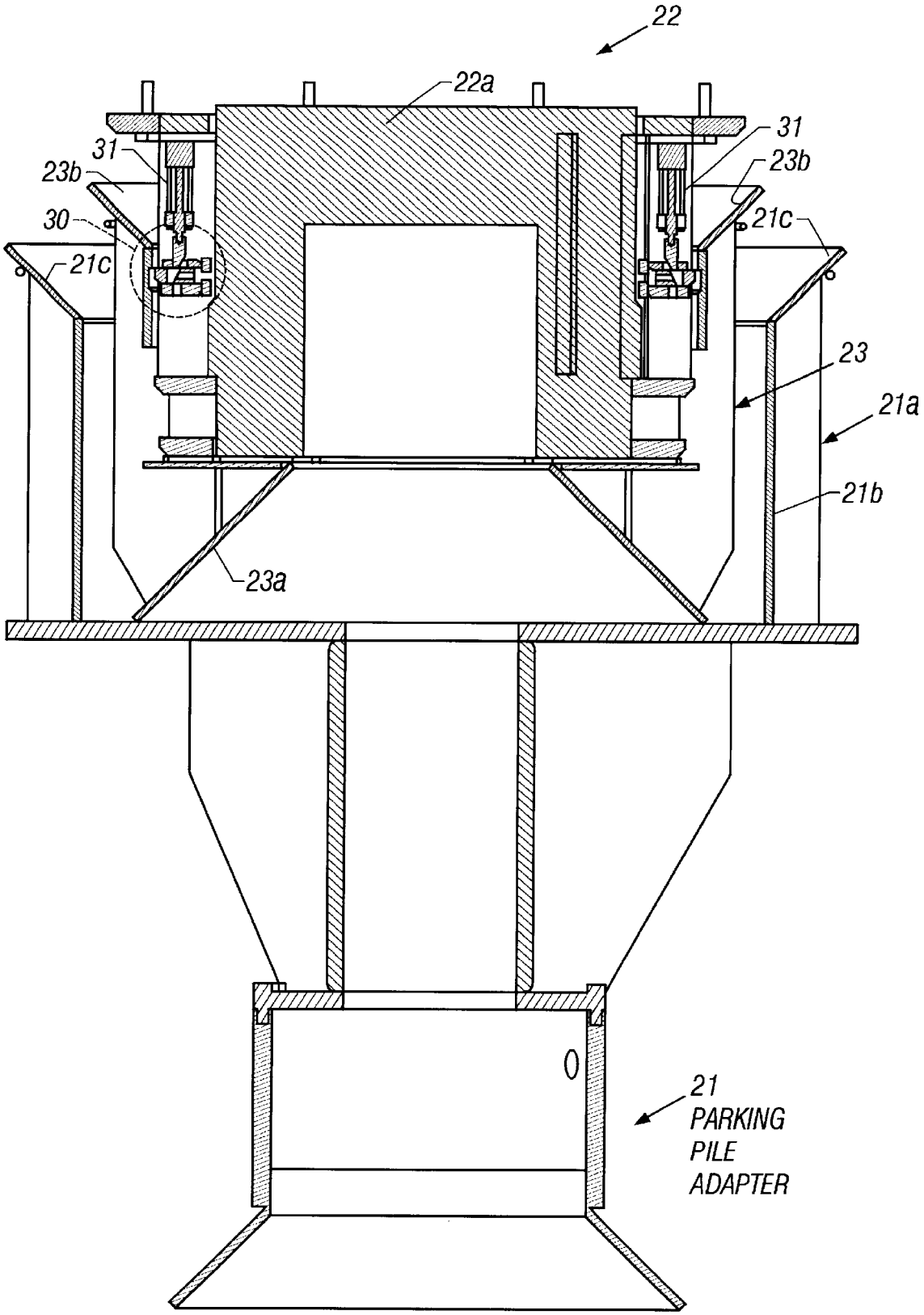
FIG. 2 is a sectional elevation view of the invention as it may be used in the environment of FIG. 1.

FIG. 2 shows a sectional view of the parking pile adapter 21, the connector shroud 22 and the guide funnel 23 according to the invention when it is in use. The parking pile adapter 21 is well known to those skilled in the art and includes a bucket 21*a* for receiving the guide funnel 23 therein. The guide funnel 23 receives the connector shroud 22 and is locked in place by a latching mechanism 30 to be subsequently described in conjunction with FIG. 3. The parking pile adapter 21 includes a bucket 21*a* having essentially vertical walls 21*b* which terminate in an upwardly opening flange 21*c*, the latter forming a funnel for receiving therein the guide funnel 23 of the present invention. The guide funnel 23 includes a downwardly opening flange 23*a* for seating within the bucket 21*a*. At its axially spaced end, the guide funnel 23 is adapted to receive, by means of upwardly opening flange 23*b*, the connector shroud 22 which includes a wellhead connector body 22*a* used to connect the BOP stack 20*a* to the wellhead 20 (see FIG. 1B). The connector shroud 22 also includes a latching mechanism 30 for attaching it to the guide funnel 23; that is, the connector shroud 22 may be connected to or disconnected from the guide funnel 23 as the operational needs dictate.

Figure 3:
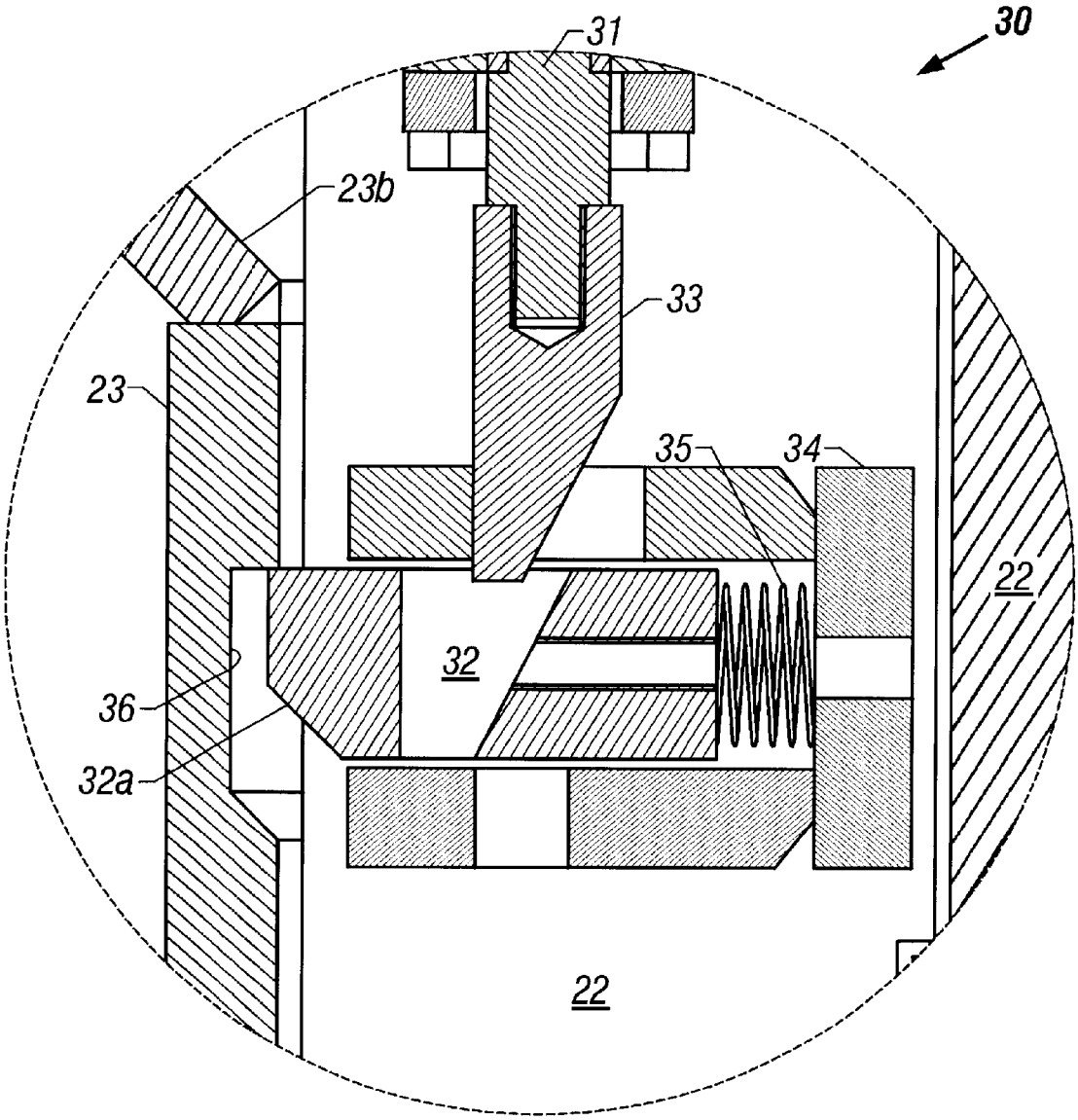
FIG. 3 is a detailed sectional view of the latching mechanism of FIG. 2.

Referring now to FIG. 3, the latching mechanism 30 includes permanently mounted parts that are inside the frame of the connector shroud 22 that lock the guide funnel in place and release it when required. These parts comprise hydraulic cylinders 31, hydraulic tubing (not shown), spring-loaded mechanical "locking dogs" 32, a wedge driving block 33 and the associated framework 34 required to hold these pieces in their proper place. The spring-loaded locking dogs 32 are extended by spring tension of spring 35 and fit into a groove 36 on the guide funnel 23 to keep it in place when required. When it is desired to release the guide funnel 23, hydraulic pressure is applied from the BOP stack (or a Remotely-Operated Vehicle "ROV") to power the cylinders 31 which in turn drive the wedge 33 into the locking dogs 32 and cause them to retract, releasing the guide funnel 23. If it is desired to reattach the guide funnel 23, hydraulic pressure is released and the locking dogs 32 extend out by virtue of the spring 35 tension. A slight taper 32*a* on the dogs 32 allows them to be driven by the weight of the BOP stack into the groove 36 on the guide funnel 23 and snap into place, thereby holding the guide funnel 23 onto the connector shroud 22. The controlling hydraulic pressure can be reversed if it is desired, with the spring 35 tension retracting (instead of extending) the locking dogs 32. However, the preferred method is to have the locking dogs 32 extended by spring 35 tension. This allows a more positive "unlock" function, since the real time saving occurs when it is necessary to drop the guide funnel 23 off of the BOP stack and into the bucket 21*a*, or onto the seafloor 14 if no parking pile adapter 21 is available for use. The BOP control system on the rig must have the necessary solenoid valves, hydraulic tubing and control panel modifications in order to accommodate the extra functions of the guide funnel latching mechanism. In addition, the BOP stack is equipped with an "ROV hot-stab" receptacle, well known to those skilled in the art, for use if the BOP control system fails to operate the hydraulic mechanism. It is mounted in an appropriate position on the BOP stack frame, readily accessible to the rig's ROV.

The guide funnel 23 opens downwardly (see flange 23*a*) and is held in place around the connector shroud 22 by the locking dogs 32. The guide funnel 23 is designed to fit the particular BOP stack frame and BOP-mounted wellhead connector and has an internal groove 36 to accept the locking dogs when they are extended from the connector shroud. The guide funnel/connector shroud assembly is designed to withstand the loads required to support the BOP stock during landing operations. The guide funnel is fitted with padeyes, shackles and slings which are used to raise the guide funnel 23 from the seafloor after it has been released if the parking pile adapter 21 is not available or is in service at the location. These may also be used to recover the guide funnel 23 in an emergency situation.

What is claimed is:

1. A subsea-releasable/reattachable guide funnel assembly comprising:

a guide funnel having a downwardly diverging conical surface forming a base adapted to seat within a bucket of a parking pile adapter;

an upwardly diverging conical surface axially spaced from said downwardly diverging conical surface of said funnel assembly to allow re-entry of a BOP stack frame into said guide funnel;

a connector shroud adapted to be received through said upwardly diverging conical surface of said guide funnel assembly;

a latching mechanism located on said shroud for releasably connecting said connector shroud and said guide funnel;

a means located on said funnel for receiving latching mechanism dogs extending from said connector shroud;

a means for engaging and disengaging said latching mechanism for connecting and disconnecting said connector shroud and said funnel; and a parking pile adapter having an ROV-operated connector to position said adapter on top of an existing parking pile on the seafloor.

2. The apparatus of claim 1 wherein said latching mechanism comprises a locking dog.

3. The apparatus of claim 2 wherein said locking dog is operated by hydraulic means.

4. The apparatus of claim 2 wherein said locking dog is operated by spring means.

5. The apparatus of claim 1 wherein said guide funnel is adaptable to accommodate a plurality of BOP stack and wellhead connector combinations.

6. The apparatus of claim 1 wherein said guide funnel is releasable and reattachable subsea and does not require "tripping" the BOP stack to the surface.

7. The apparatus of claim 2 wherein said latching mechanism is controlled by an existing BOP control system.

8. The apparatus of claim 2 wherein said latching mechanism is controlled by an ROV "hot stab".

* * * * *